US007134464B2

(12) United States Patent
Walker et al.

(10) Patent No.: US 7,134,464 B2
(45) Date of Patent: Nov. 14, 2006

(54) LOG SPLITTER

(75) Inventors: Thomas Michael Walker, Streator, IL (US); Christopher Gerard Walker, Streator, IL (US)

(73) Assignee: Brave Products, Inc., Streator, IL (US)

( * ) Notice: Subject to any disclaimer, the term of this patent is extended or adjusted under 35 U.S.C. 154(b) by 182 days.

(21) Appl. No.: 10/876,326

(22) Filed: Jun. 24, 2004

(65) Prior Publication Data

US 2005/0284540 A1 Dec. 29, 2005

(51) Int. Cl.
*B27L 7/06* (2006.01)

(52) U.S. Cl. ..... 144/193.2; 144/195.1

(58) Field of Classification Search ..... 144/193.1, 144/193.2, 195.6–195.8, 195.1, 366
See application file for complete search history.

(56) References Cited

U.S. PATENT DOCUMENTS 4,351,377 A * 9/1982 Hamel ..... 144/195.1
4,366,848 A * 1/1983 Gavinski ..... 144/195.1
4,411,298 A 10/1983 Ellingsen et al.
4,441,535 A * 4/1984 Flinn et al. ..... 144/4.6
4,503,894 A 3/1985 Gratkowski
4,615,366 A * 10/1986 Scarbrough, Jr. ..... 144/195.1
2005/0284541 A1* 12/2005 Walker et al. ..... 144/193.2

OTHER PUBLICATIONS

1. Brave Products (4-Page Brochure).
2. Brave Products, VH9922 Vertical/Horizontal Log Splitter (One Page Flyer).
3. Brave Products, VH9926 Vertical Horizontal Log Splitter (One Page Flyer).
4. Brave Products Hand Tools & Accessories (One Page Flyer).
5. Iron & Oak, BHVH3402, Vertical/Horizontal Log Splitter.
6. Iron & Oak, Tractor Mount Vertical/Horizontal Log Splitters.
7. Iron & Oak, BHVH2202FC, Vertical/Horizontal Log Splitter.

* cited by examiner

*Primary Examiner*—Lowell A. Larson
*Assistant Examiner*—Shelley Self
(74) *Attorney, Agent, or Firm*—Barnes & Thornburg LLP; Mark J. Nahnsen

(57) ABSTRACT

A log splitter which includes an elongated frame having a reservoir for hydraulic fluid a wedge secured to one end of the frame and a hydraulic cylinder and ram/piston secured to the other end of the frame. The ram/piston being movable toward and away from the wedge. The reservoir includes an inlet and outlet and a discharge tube associated with the inlet or outlet and having a length effective to discharge incoming fluid into the reservoir at a position remote from the inlet to prevent short circuiting. A log splitter and arm for mounting the splitter to a vehicle having a hitch style receiver secured to the rear of the vehicle. The splitter is adapted to be secured to an elongated arm and supported above the ground. The splitter's linear working action is substantially normal to the vehicle's direction of movement.

12 Claims, 5 Drawing Sheets

FIG. 1
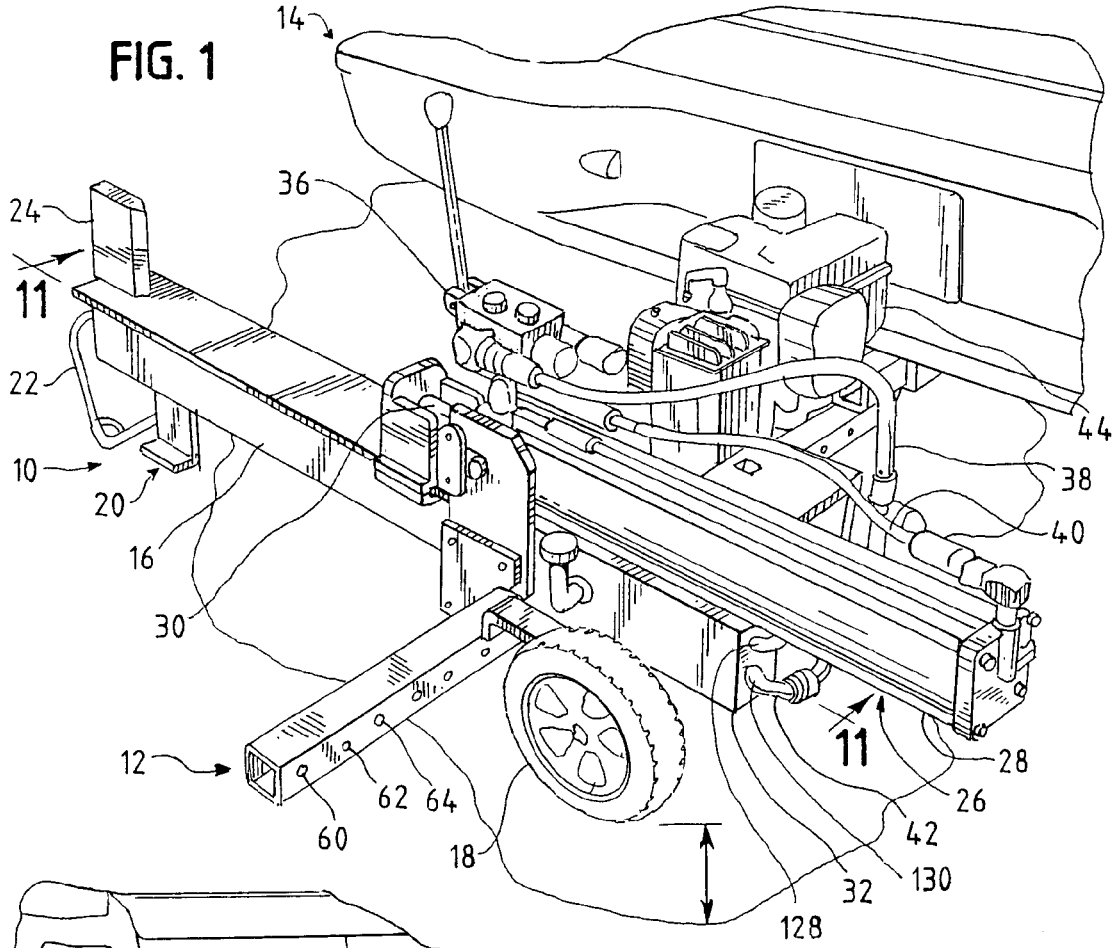
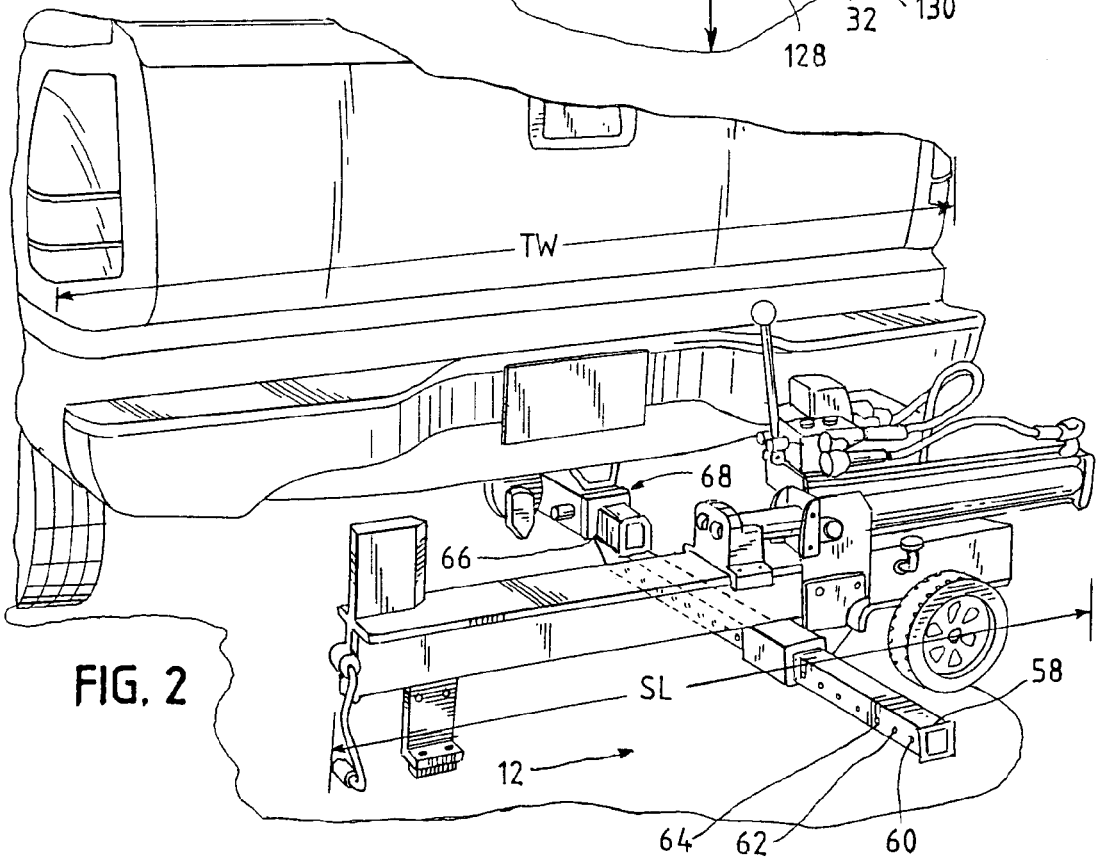
FIG. 2

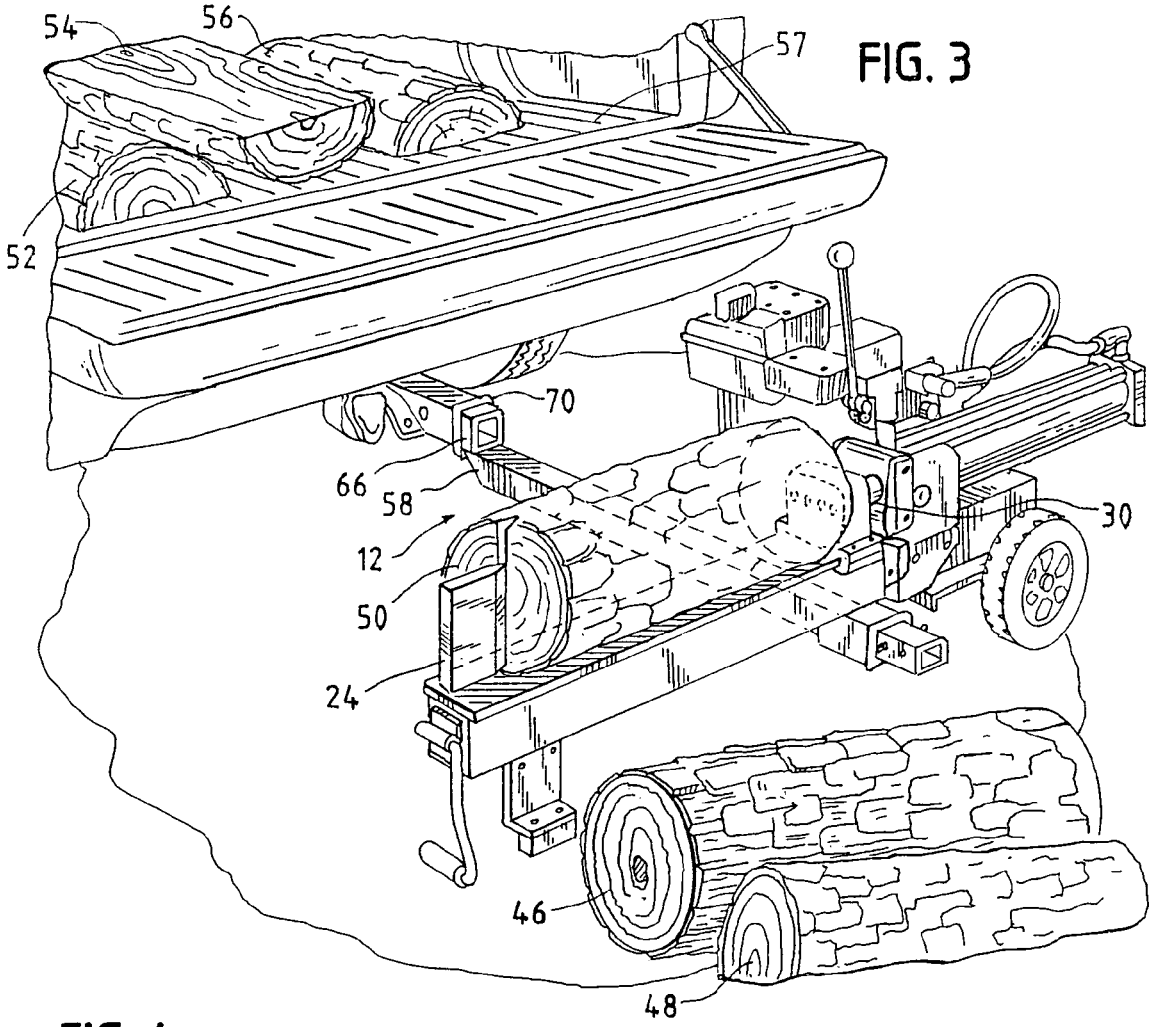
FIG. 3
FIG. 4
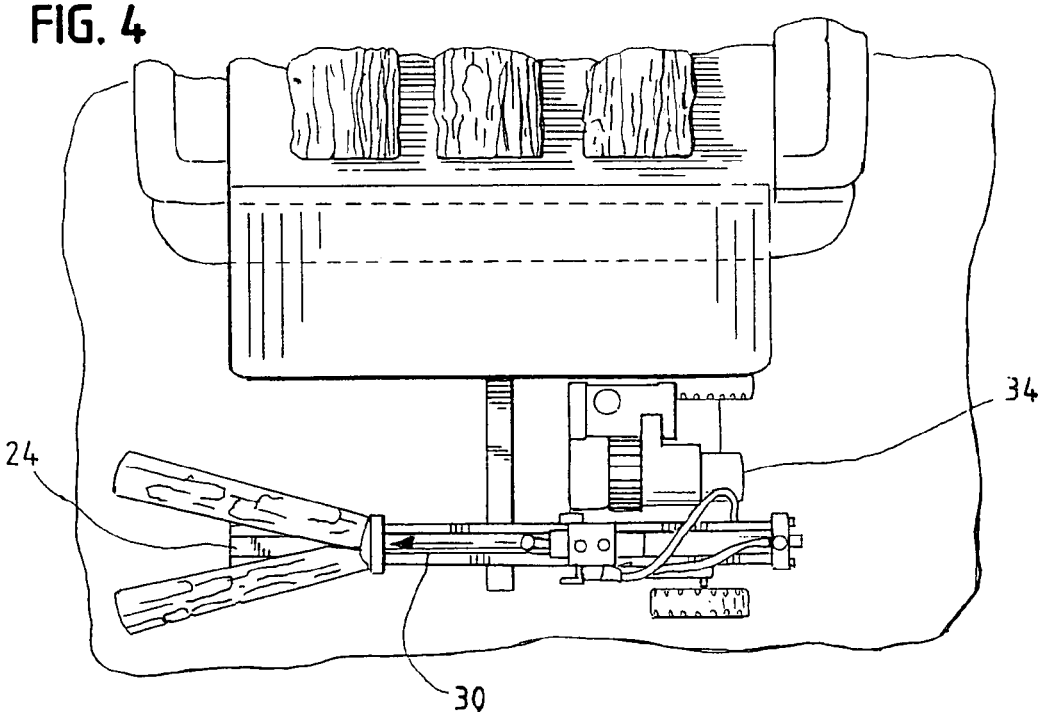

LOG SPLITTER

FIELD OF THE INVENTION

This invention relates to log splitters and more particularly to a log splitter which is smaller and lighter in weight than available conventional splitters and that can be mounted to and carried on a vehicle on a road or highway.

BACKGROUND OF THE INVENTION

Wood in the form of logs is frequently used as a fuel in stoves, fireplaces, furnaces and at remote locations such as campsites. The log must be of a size suitable for use. Usually this means that the log is to be cut and split to size. Such sizing can be by a hydraulic log splitter wherein a hydraulic ram drives the log against a wedge which splits or cuts the log.

Frequently the source of wood or logs is in a remote location, such as a forest. Thus, it is necessary to bring the log splitter to the location. In addition, the site where the wood is to be used can be nearby or may be a substantial distance from the site where the wood is to be collected or secured. Thus, it is desirable to transport the log splitter to the collection or use site using a vehicle such as a pick-up truck which can travel on a highway or road at speeds such as 55 miles per hour (mph).

However, it has been found that available log splitters are not suitable for highway use since they are not towable at highway speeds. Moreover, such log splitters present problems when the vehicle is backed up, particularly as it can't be seen due to its short width.

Therefore, it is an object of this invention to provide a log splitter and mounting system for a pick-up truck or similar vehicle, that is to be used on a highway, at highway speeds, which mounting system is compatible with such use.

Furthermore, it is desirable to provide a splitter than can be used for residential projects, can be stored in a residential garage, can be moved by hand, can be used at a camp site and can be easily shipped. Conventional and available splitters are too large and too heavy for such uses and/or shipment.

Thus, it is another object of this invention to provide a splitter which fulfills such residential or local uses and can easily be shipped.

These and other objects of this invention will become apparent from the following description and appended claims.

SUMMARY OF THE INVENTION

There is provided a splitter which is smaller and lighter in weight than conventional splitters so as to meet the uses described above. The splitter includes an elongated frame, a wedge at one end of the frame and a hydraulic cylinder and piston/ram at the other end of the frame. The piston/ram is movable toward and away from the wedge. A hydraulic fluid reservoir is provided in association with the frame and includes an elongated inlet tube within the reservoir for maximizing the mixing of hydraulic fluid entering the reservoir with fluid therein and minimizes the direct flow of fluid from the inlet to the outlet.

In addition, there is provided by this invention a log splitter and mounting system which permits the mounting of the splitter on the back of a pick-up truck or the like, spacing of the splitter above the road surface on which the vehicle operates, and the use of the truck or other vehicle at normal highway speeds. The mounting system includes an elongated and stepped support arm that is secured at one end to a hitch mounting or receiver on the rear of the truck. The arm is connected to and extends rearwardly from the hitch in a cantilevered manner. Due to the stepped construction, the arm can be rotated to adjust the splitter's clearance from the highway.

The splitter is mounted to the support arm at an orientation transverse to the arm and generally parallel to the back of the truck. Thus, the working action (i.e., movement of the piston/ram) of the splitter, is substantially linear, transverse to the support arm and transverse to the normal direction of movement of the vehicle.

The length of the splitter is equal to the width of the truck, so as to avoid the splitter overhanging the truck sides and extending beyond the truck width into the road.

With this system, the splitter is smaller and of a lighter weight than conventional splitters and with the mounting system, can be mounted to a truck, spaced above the road surface and the truck can travel, with the splitter, at acceptable highway speeds.

BRIEF DESCRIPTION OF THE DRAWINGS

FIG. 1 is a perspective style view of a log splitter on a securement arm taken from the back of the truck at the hydraulic cylinder end of the splitter;

FIG. 2 is similar to FIG. 1 except taken from the other side and showing the hitch and securement/mounting arm;

FIG. 3 is a view similar to FIG. 2 showing the truck tailgate in a lowered position, logs on the ground, a log being split and split logs on the truck bed;

FIG. 4 is a plan view looking downwardly and showing a log on the splitter being split;

DESCRIPTION OF THE PREFERRED EMBODIMENT

Figure 7:
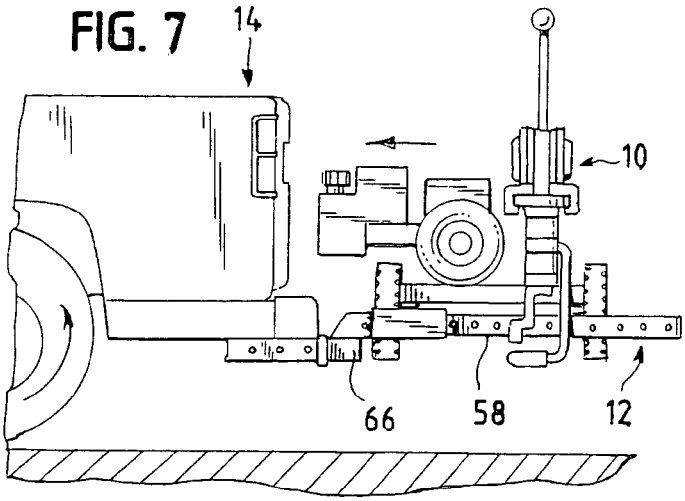
FIG. 7 is a side view showing the back of a truck with the truck's tailgate raised, the securement arm in an upper position, and the splitter carried by the arm and positioned near the rear of the truck.

Referring now to the drawings and figures such as FIGS. 1 and 7, there is seen a log splitter 10 generally that is mounted to and carried by a support arm 12 generally which is mounted to the back of a vehicle 14 generally and above the road surface.

The splitter 10 generally includes an elongated frame 16 which includes a pair of wheels, such as 18, mounted to the underside and at one end of the frame. An arm or stop bracket 20 is also on the underside of the frame at the other end. A lifting handle 22 is secured to the frame adjacent the arm or stop bracket 20 so as to permit the splitter to be lifted and rolled to a destination, like the mounting position or a position for use off the support arm.

A log splitting wedge 24 is mounted to the top side of the frame at one end and generally above the stop bracket. A hydraulic cylinder assembly 26 is mounted at the other end of the frame above the wheels, such as 18. The cylinder assembly includes a cylinder 28, a piston ram 30 (best seen in FIGS. 3, 4 and 10), a hydraulic reservoir 32, a hydraulic pump 34 (seen in FIG. 4), a hydraulic valve and control 36 and hydraulic lines 38, 40 and 42. The reservoir 32 extends the length of, and acts as the frame 16. A small internal combustion engine 44 is provided to drive the pump. In operation, the engine 44 powers the pump through which the valve 36 permits the hydraulic fluid to move via lines 38, 40 and 42 between the reservoir 32 and the cylinder 28. This flow of hydraulic fluid causes the piston ram 30 to advance from the cylinder 28 toward the wedge 24 or retract from the wedge into the cylinder.

Referring now to FIGS. 3 and 4, logs such as 46, 48 and 50 are positioned on the splitter between the ram and wedge. The log is split by the piston ram 30 engaging the log 50 and urging it against the wedge 24.

The split log segments such as 52, 54 and 56 are then loaded on to the truck bed 57.

Figure 5:
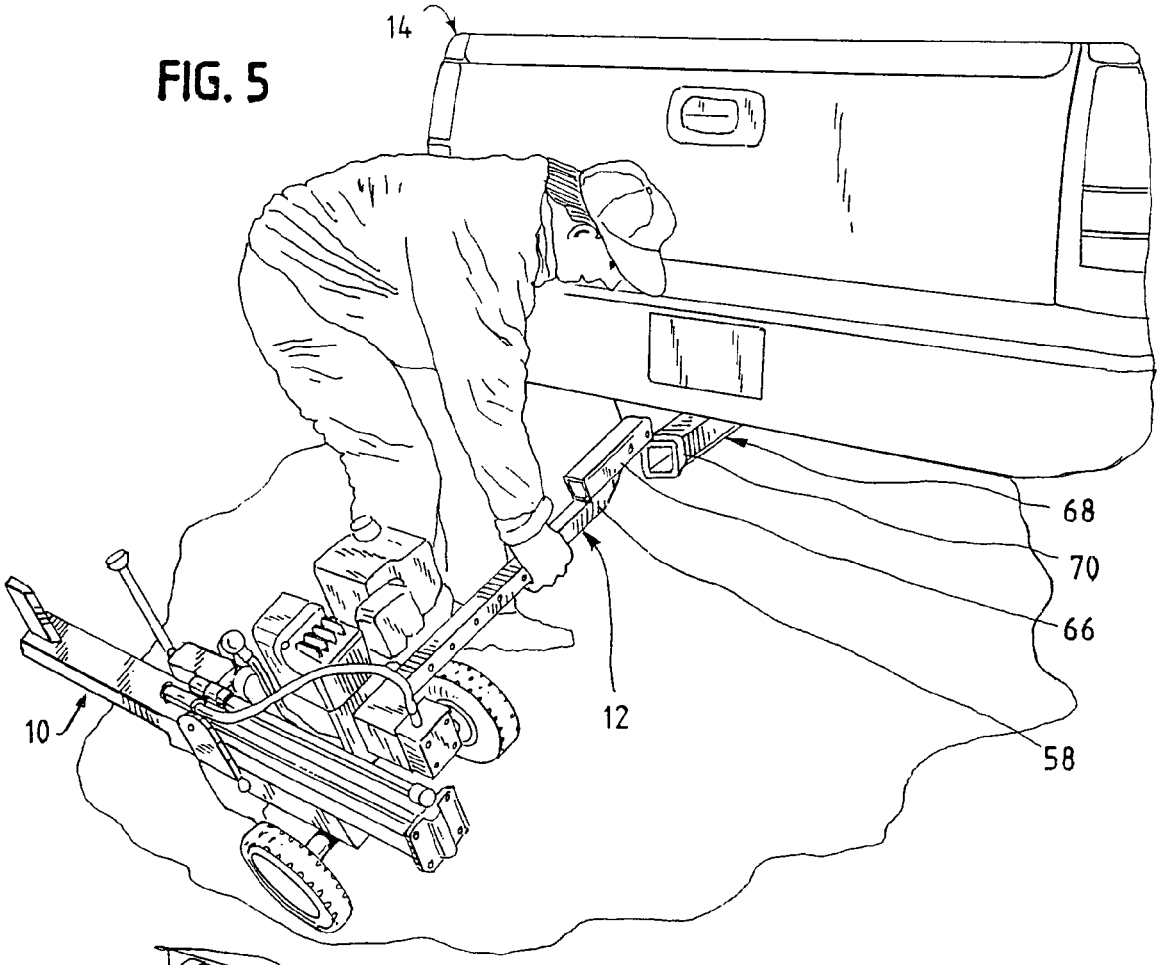
FIG. 5 is a view showing the splitter and support arm positioned for mounting in the truck's hitch or receiver.
Figure 6:
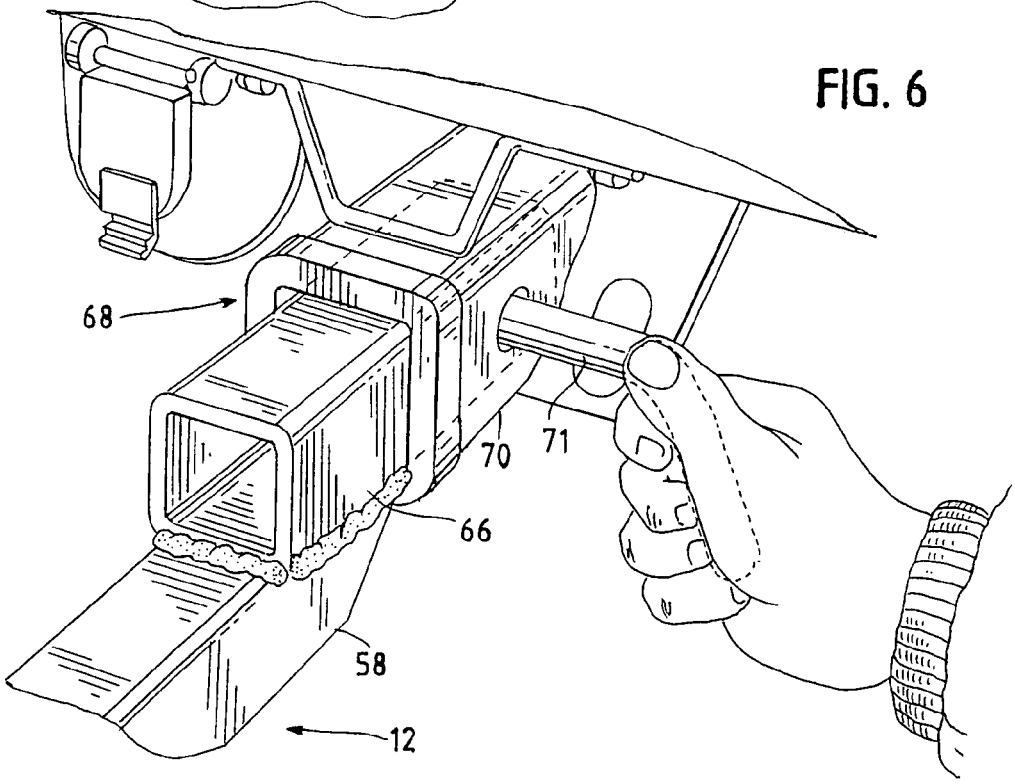
FIG. 6 is an enlarged view showing one end of the mounting arm in the hitch receiver and being secured thereto by a pin.

The support arm 12 includes a long splitter-carrying segment 58 that includes a plurality of longitudinally arranged apertures such as 60, 62 and 64. The segment 58 is a hollow square-shaped member. A short hitch engaging segment 66 is welded to the long segment 58 at the end of the arm 12. This is seen in FIGS. 5 and 6. Except for the length, the short segment 66 is akin to the long segment 58 and is a hollow square shape.

The truck 14 is provided with a hitch receiver assembly 68 that includes a hollow square shaped tubular member 70 secured to the truck frame.

Referring to FIG. 6, the short segment 66 is inserted into the square shaped tubular member 70 until the long segment 58 engages an edge of the hitch. Then a locking pin 71 is inserted through the hitch and segment 66 to secure the support arm 12 in a locked and cantilevered position above the road surface. It will be appreciated that the arm can be rotated 180° about its length so that the long segment's clearance relative to the road can be adjusted. See FIGS. 6 and 7.

Referring now to FIG. 5, it is seen that the log splitter 10 is rolled into position behind the truck 14 and the securement arm 12 is lifted into position relative to the hitch. The splitter is then lifted and pushed toward the truck and the support arm 12, specifically segment 66 is slid into the tubular member 70 and secured thereto by pin 71.

The log splitter 10 includes on its underside, a bracket-like assembly 100 which supports the motors and pumps. The bracket 100 includes a base plate 102, a pair of support members 104 and 106 and a tubular slide member 108. Each of the support members 104 and 106 are secured to the base and slide member 108. The slide member 108 is a tubular member having a square cross-section which fits in a telescoping manner about the long segment 58 of the support arm 12.

The base 102 includes axles 110 and 112 for wheels such as 18. As indicated above, the internal combustion engine 44, the hydraulic cylinder 28 and the hydraulic pump 34 and other splitter parts are mounted to or carried by the base.

Thus, by sliding the member 108 on the segment 58, the splitter 10 is moved along the length of the arm 12 and toward or away from the pick-up truck 14. The slide member 108 is fixed in position on the segment 58 by the use of pin assemblies such as 114 and 116. Each assembly includes a headed pin member 118 or 120 and a cotter pin 122 or 124. Each pin member 118 and 120 are constructed to pass through an aperture such as 60, 62 and 64 in the segment 58. The pins are positioned on either end of the slide member 108 so as to keep the member 108 and the splitter 10 in position on the segment. The pins are held in the segment holes by the cooperation of the cotter pins 122 and 124 and the pin heads 118*a* and 120*a*. It will be appreciated that this securement mechanism can be used when the splitter is moved toward or away from the truck.

Figure 8:
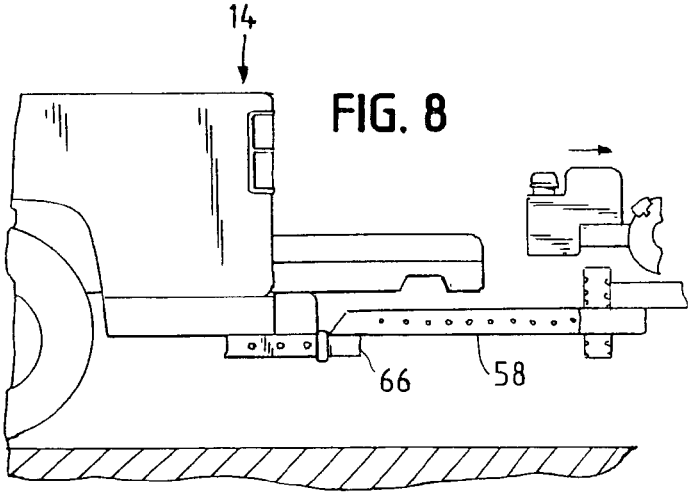
FIG. 8 is similar to FIG. 7 with the truck tailgate lowered and the splitter moved rearwardly on the support arm.
Figure 9:
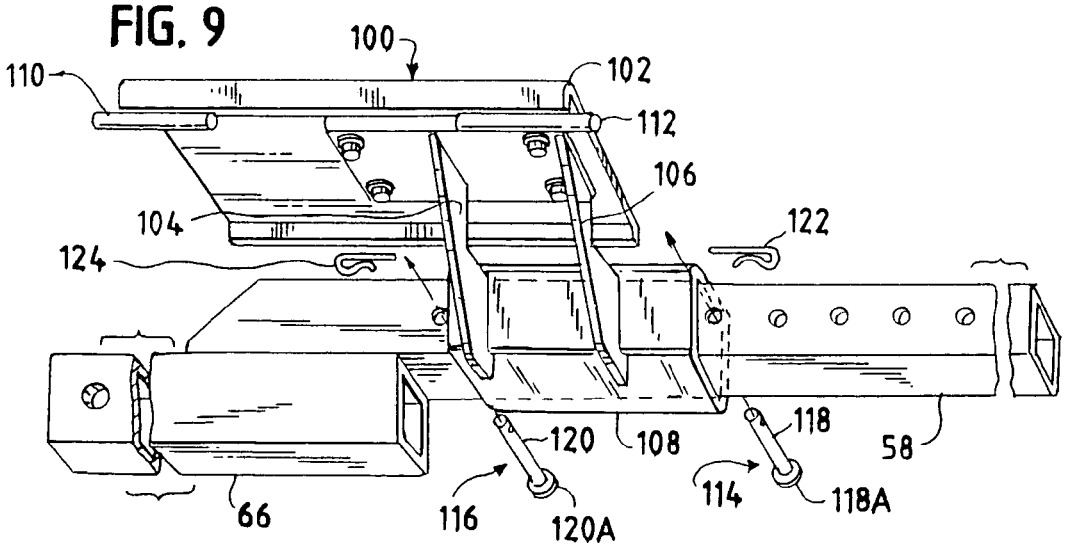
FIG. 9 is a perspective style view taken from the bottom of the splitter showing the support arm and a support bracket, the manner in which the splitter attaches to the arm and a base for splitter components such as the motor and hydraulic pump.

Usually, the splitter 10 is moved toward the truck, as seen in FIG. 7, when the splitter is to be transported and away from the truck when the truck reaches its destination where the splitter is used. There the pins 120 and 118 are removed and the splitter is moved to a rearward position on the support arm 12 as seen in FIG. 8. At this position, the splitter can be resecured in position on the arm by the pins 120, 118 or removed from the arm for use on the ground.

Figure 10:
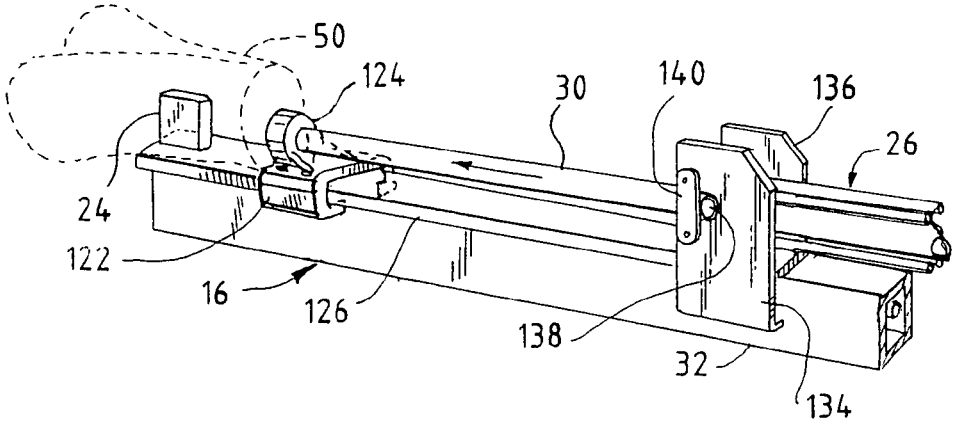
FIG. 10 is a diagrammatic style view showing the operation of the hydraulic ram and a guide system for the ram.

Referring now to FIG. 10, it is seen that the ram 30 is extended and is urging the log 50 into the wedge 24 in order to guide the movement of the ram 30, a somewhat "C" shaped bracket 122 is provided in association with the ram head 124. The bracket 122 grasps the rail 126 on the frame.

Referring now to FIG. 2, the length SL of the splitter is less than or equal to the width (TW) of the pick-up truck. Usually the splitter length (SL) is about equal to the truck width (TW).

As indicated above, the log splitter includes the splitter frame 16, wheels such as 18, the arm or stop bracket 20, the lifting handle 22 and a log splitting wedge 24. With respect to the hydraulics of the system, there is included a hydraulic cylinder assembly 26 which includes the cylinder 28 and piston arm 30, the hydraulic pump 34, the hydraulic valve 36 and the hydraulic lines 38, 40 and 42. The pump 34 driven by the internal combustion engine 44.

Figure 11:
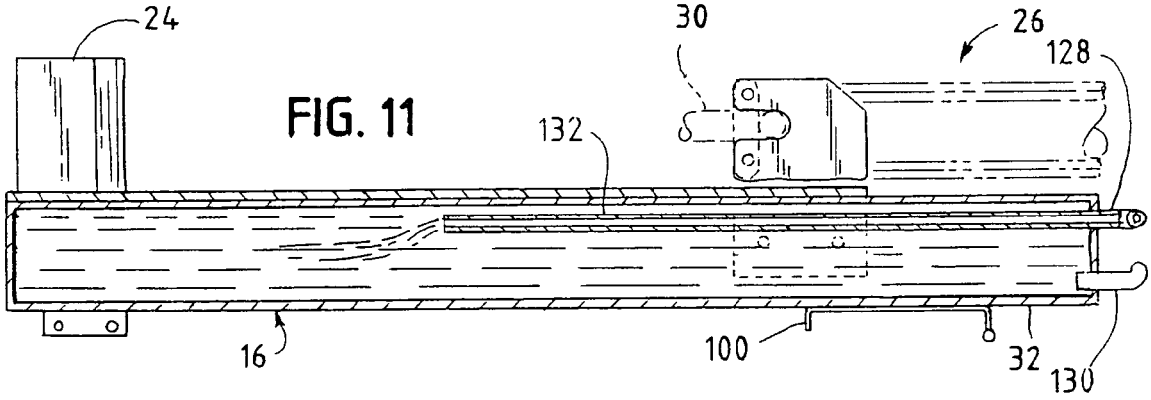
FIG. 11 is a vertical sectional view taken along line 11—11 of FIG. 1 showing the reservoir and inlet tube associated with the frame.
Figure 12:
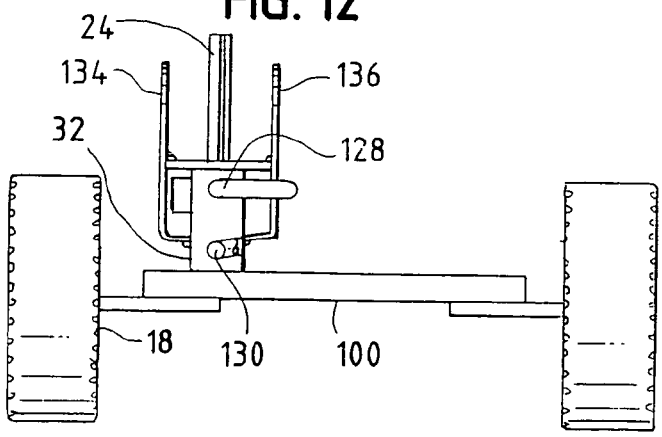
FIG. 12 is an end view showing the reservoir wedge support plate form and wheels for the splitter of this invention.

Referring now to FIGS. 1 and 11, it is seen that the reservoir 32 forms the frame 16. The reservoir is basically an elongated and rectangularly shaped member which is secured to the bottom bracket or platform 100. The reservoir 32 includes an inlet 128 which receives oil that has been used in the cylinder and which may be hot. An inlet tube is secured to the tank at the inlet and is about ½ the length of the *reservoir*. T*hus*, incoming hydraulic fluid is discharged into the tank remote from the inlet 128. T*his* permits the hot fluid to dilute itself and cool itself within the *reservoir*. A*n* outlet 130 is provided for the withdrawal of fresh fluid from the tank for *use*. T*he* length of tube 132 is sufficient and effective to discharge the fluid in the tank and prevent the direct flow of discharge fluid to the *outlet*. I*n* other *words*, incoming fluid is not *short-circuited* to the *outlet*.

A pair of cylinder support trunions 134, 136 are welded to the reservoir or frame and the hydraulic assembly 26 is secured thereto by pins such as 138 and a small closure bracket 140.

Numerous changes and modifications can be made to the embodiment disclosed herein without departing from the spirit and scope of this invention.

What is claimed is:

1. A log splitter for splitting logs comprising:

an elongated frame member;

a log splitting wedge mounted at one end of the frame member;

a hydraulic cylinder and piston/ram assembly coupled to the frame member at the other end thereof and constructed for the ram to move between the cylinder and the wedge;

a hydraulic pump and hydraulic valve for communication of hydraulic fluid to and from the cylinder;

a motor for operating said pump;

a platform associated with the frame member for supporting the pump, valve and motor;

a plurality of wheels rotatably secured to the platform for cooperation in supporting and moving said splitter;

said frame defining a reservoir for holding hydraulic fluid, said reservoir including an inlet adapted to receive fluid, and an outlet adapted to permit the withdrawal of fluid from the reservoir, and wherein the inlet includes an elongated tube segment positioned within the reservoir, the elongated tube segment having a effective length within the to discharge fluid into the reservoir at a position within the reservoir remote from the outlet to increase the retention time of the fluid entering the reservoir from the inlet before being drawn through the outlet.

2. A log splitter as in claim 1 wherein the length of the elongated tube segment is effective to maximize the mixing of incoming fluid with stored fluid in the reservoir and minimize direct flow of fluid between the inlet and outlet.

3. A log splitter as in claim 1 wherein the elongated tube segment extends substantially within the reservoir.

4. A log splitter as in claim 2 wherein the length of the elongated tube segment positioned within the reservoir is about half the length of the reservoir.

5. A log splitter for splitting logs comprising:

an elongated frame having a reservoir for hydraulic fluid, said reservoir including first and second passageways to permit fluid to flow into and out of the reservoir;

a log splitting wedge coupled at one end of the frame;

a hydraulic cylinder assembly coupled to the other end of the frame, including a piston/ram construction which is movable toward and away from the wedge, and said cylinder assembly operably associated with the first and second passageways; and wherein on of passageways includes an elongated tube segment having an opening positioned within the reservoir for use in the communication of hydraulic fluid between the reservoir and the cylinder, the elongated tube segment having a effective length within the reservoir to allow the movement of fluid through an opening in the elongated tube at a position within the reservoir remote from the said passageways to increase the retention time of the fluid entering the reservoir.

6. A small light-weight log splitter as in claim 5 including a valve for communication of hydraulic fluid to and from said reservoir and to and from said cylinder.

7. A small light-weight log splitter as in claim 5 including a hydraulic pump, and an hydraulic valve associated with the hydraulic pump, the reservoir and the cylinder assembly for communication of fluid between the reservoir and cylinder.

8. A log splitter as in claim 5 wherein one of said passageways is positioned above the other passageways.

9. A log splitter as in claim 5 wherein the elongated tube segment is operatively associated with the first passageway.

10. A log splitter as in claim 5 wherein the length of the elongated tube segment is effective to prevent the short circuiting of hydraulic fluid between the first and second passageways to enhance the mixing of fluid flowing into the reservoir with fluid in the reservoir.

11. A log splitter as in claim 5 wherein the length of the elongated tube segment is about half the length of the reservoir.

12. A log splitter as in claim 7 wherein there is further provided:

a platform associated with the frame for supporting the hydraulic pump, that hydraulic valve and the hydraulic motor; and a plurality of rotatable wheels secured to the platform for cooperation in supporting and moving the piston/ram.

* * * * *